US005426833A

United States Patent [19]

van Riesen

[11] Patent Number: 5,426,833

[45] Date of Patent: Jun. 27, 1995

[54] BELT FASTENER WITH A SAFETY BELT ARRANGEMENT

[76] Inventor: Reiner van Riesen, Besenheide 36, 2200 Elmshorn, Germany

[21] Appl. No.: 984,432

[22] PCT Filed: Jul. 28, 1992

[86] PCT No.: PCT/DE92/00613

§ 371 Date: Mar. 5, 1993

§ 102(e) Date: Mar. 5, 1993

[87] PCT Pub. No.: WO93/02582

PCT Pub. Date: Feb. 18, 1993

[30] Foreign Application Priority Data

Jul. 29, 1991 [DE] Germany ..... 41 25 028.1

[51] Int. Cl.[6] ..... A44B 11/25

[52] U.S. Cl. ..... 24/633; 24/197

[58] Field of Search ..... 24/197, 519, 633, 641

[56] References Cited

U.S. PATENT DOCUMENTS

| | | | |
|---|---|---|---|
| 2,809,408 | 10/1957 | Goldstein | 24/197 X |
| 3,584,896 | 6/1971 | Jantzen . | |
| 3,894,768 | 7/1975 | Connors et al. . | |
| 3,912,329 | 10/1975 | Connors et al. . | |
| 4,540,218 | 9/1985 | Thomas | 24/633 X |
| 5,220,713 | 6/1993 | Lane, Jr. et al. | 24/633 X |
| 5,265,910 | 11/1993 | Barr et al. | 24/197 X |

FOREIGN PATENT DOCUMENTS

| | | | |
|---|---|---|---|
| 0105972 | 4/1984 | European Pat. Off. . | |
| 0347505 | 12/1989 | European Pat. Off. . | |
| 2426587 | 12/1979 | France . | |
| 2849905 | 5/1980 | Germany . | |
| 3504142 | 8/1986 | Germany | 24/633 |

*Primary Examiner*—Edward K. Look
*Assistant Examiner*—John Ryznic
*Attorney, Agent, or Firm*—Dvorak and Traub

[57] ABSTRACT

The safety belt device described for child safety seats in motor vehicles comprises a belt fastener (1) with a belt arrangement (4) comprising pelvic and shoulder belt (13, 14). The belt :fastener (1) comprises the conventional closure device (2) and a single, belt-guiding end piece (3) having an inclined belt guide slot (9). One end of the shoulder belt is attached to the pelvic belt near the closure device (2) of the belt fastener (1), and the other end of the shoulder belt (14) is attached to the belt end piece (3) of the belt fastener (1) while forming a longitudinally adjustable loop (21) in the pelvic belt region. The loop (21) therefore has pelvic belt function over a short distance and passes through an eye part (16), to which one end of the pelvic belt (13) is attached. The other end of the pelvic belt is attached to the closure device (2) of the belt fastener (1) (FIG. 1).

6 Claims, 2 Drawing Sheets

BELT FASTENER WITH A SAFETY BELT ARRANGEMENT

BACKGROUND OF THE INVENTION

1. Field of the Invention

The invention relates to a belt fastener with a safety belt arrangement comprising shoulder belt and pelvic belt for child safety seats in motor vehicles, wherein the belt fastener comprises a closure device and an insertion device which can be locked therewith with belt guide slot extending at an angle to the central longitudinal axis of the closure device for passage of a section of the shoulder belt, and wherein one end of the pelvic belt is attached to the closure device of the belt fastener.

2. Description of the Prior Art

German Gebrauchsmuster 89 07 836 describes a belt fastener with a safety belt arrangement of the type given above. It comprises a three-part belt fastener, namely a closure device which can be actuated by means of a button and two end pieces for guiding and retaining the belt straps, as well as a belt arrangement in which the two shoulder belts change over into the pelvic belt at the point where they pass through the end pieces without discontinuity. Furthermore, the belt arrangement also includes a crotch belt which is attached to the closure device of the belt fastener. All belts are fixed on the other side of the child safety seat.

In this known belt securing system for child safety seats in motor vehicles, there is a considerable danger of injury to the secured child. When there is stress, that is when there is an accident or braking, the crotch belt of the belt arrangement may lead to injury of the child in the genital region, if the safety seat itself has not been attached correctly and/or the child has assumed an unfavourable position in the safety seat, designed in most cases as a shell seat, because of its usual movements. A further danger of injury to the child consists in that it can squeeze itself in the pelvic belt region in spite of a belt arrangement which is adjusted and applied according to the regulations, because the entire belt fastener can slip downwards, for example due to the usual movements of the child in its seat, for example by bending forward, as a result of which the pelvic belt becomes very tight. At the same time the two shoulder belts thus have too much play, as a result of which the safety effect of these belts is lost for the most part and thus the danger of injury to the child is also increased in the event of stress. Furthermore, operation of this belt fastener is clumsy, since three fastener parts have to be pushed together in the correct sequence, namely initially the two end pieces for the belts which are then inserted together into the closure device. Holding together the two end pieces thus requires a certain dexterity, because the other hand must find, grip and hold the closure device with the crotch belt. The size of this known belt fastener also causes a certain clumsiness in the handling of the safety belt system.

The object of the invention is to improve a belt fastener with safety belt arrangement of the type mentioned in the introduction, so that the adjustment of the safety belt device applied according to the regulations can essentially not be changed both in the event of stress or in a case without stress while maintaining a comfortable strapped-in feeling, for better protection of the child in its seat, so that the operation of the belt fastener is simplified still further and so that the entire belt securing device has a more compact design and is cheaper to manufacture.

SUMMARY OF THE INVENTION

This object is achieved according to the invention in that the insertion device of the belt fastener comprises a single belt end piece, the inclined belt guide slot of which intersects the central longitudinal axis of the closure device, in that the other end of the pelvic belt is provided with an eye part, in that the shoulder belt is attached on one side to the pelvic belt near its attachment point on the closure device, and in that the shoulder belt returns to a single belt end piece, and is attached thereto, on the other side, after it passes through the inclined belt guide slot of the belt end piece while forming a longitudinally adjustable loop through the eye part (sic), as a result of which the loop is shortened when the shoulder belt is subject to tensile stress and consequently the pelvic belt is tightened with increased traction.

The safety belt device of the invention reduces the danger of injury to the child in its safety seat considerably. Injury and/or development of pain in the genital region is no longer possible because of the omission of the crotch belt. The belt fastener itself is also no longer able to slip downwards in spite of the usual movements of the child in its seat in the belt system, because a shoulder belt is attached directly to the pelvic belt. This also prevents the child from being able to squeeze itself due to unintentional tightening of the belt sections themselves and injuring itself. Hence the adjustment of the belt device applied according to the regulations once set, does not change and therefore ensures optimum protection for the child. At the same time, the belt device applied according to the regulations permits the secured child enough movement so that the child does not have the uncomfortable feeling of being strapped in and more or less not being able to move. Furthermore, the entire belt securing device has a simpler and more compact design and is cheaper to manufacture. There is no belt end piece, since the shoulder belt concerned is attached directly to the pelvic belt, and no crotch belt. The overall size of the belt fastener is thus considerably reduced. Operation of the belt fastener is also quicker and simpler to carry out, since only one belt end piece need be inserted in the closure device, so that prior fitting of belt end pieces with one another is also omitted.

On its lower side the single belt end piece preferably has a bar in a recess, to which bar the end of the shoulder belt forming the loop is attached. This permits simple application of the shoulder belt.

Furthermore, on its upper side the belt end piece advantageously has a clip, which together with the upper surface of the end piece forms a direction-stabilising passage slot for the shoulder belt. This ensures secure passage of the shoulder belt through the inclined belt guide slot in the belt end piece.

Preferably, the inclined belt guide slot of the belt end piece has a quadrilateral shape and is arranged to extend diagonally therein.

In a further preferred embodiment, the section of the shoulder belt assigned to the closure device of the belt fastener is sewn onto the pelvic belt.

Advantageously, the shoulder belt comprises an integral belt strap, which is guided to be movable in the upper region of the child safety seat and one of the two front shoulder belt sections thus formed is provided with an adjuster adjusting the length of the shoulder belt.

The foregoing summary of the invention, as well as the following detailed description of the preferred embodiments, will be better understood when read in conjunction with the appended drawings. For the purposes of illustrating the invention, there are shown in the drawings embodiments which are presently preferred, it being understood, however, that the invention is not limited to the specific arrangements and instrumentalities disclosed.

FIG. 1 shows a plan view of the belt fastener with the safety belt arrangement shown partly as a dot-and-dash line, FIG. 2 shows an essentially sectioned representation along the line II—II in FIG. 1.

DESCRIPTION OF THE PREFERRED EMBODIMENTS

Figure 1:
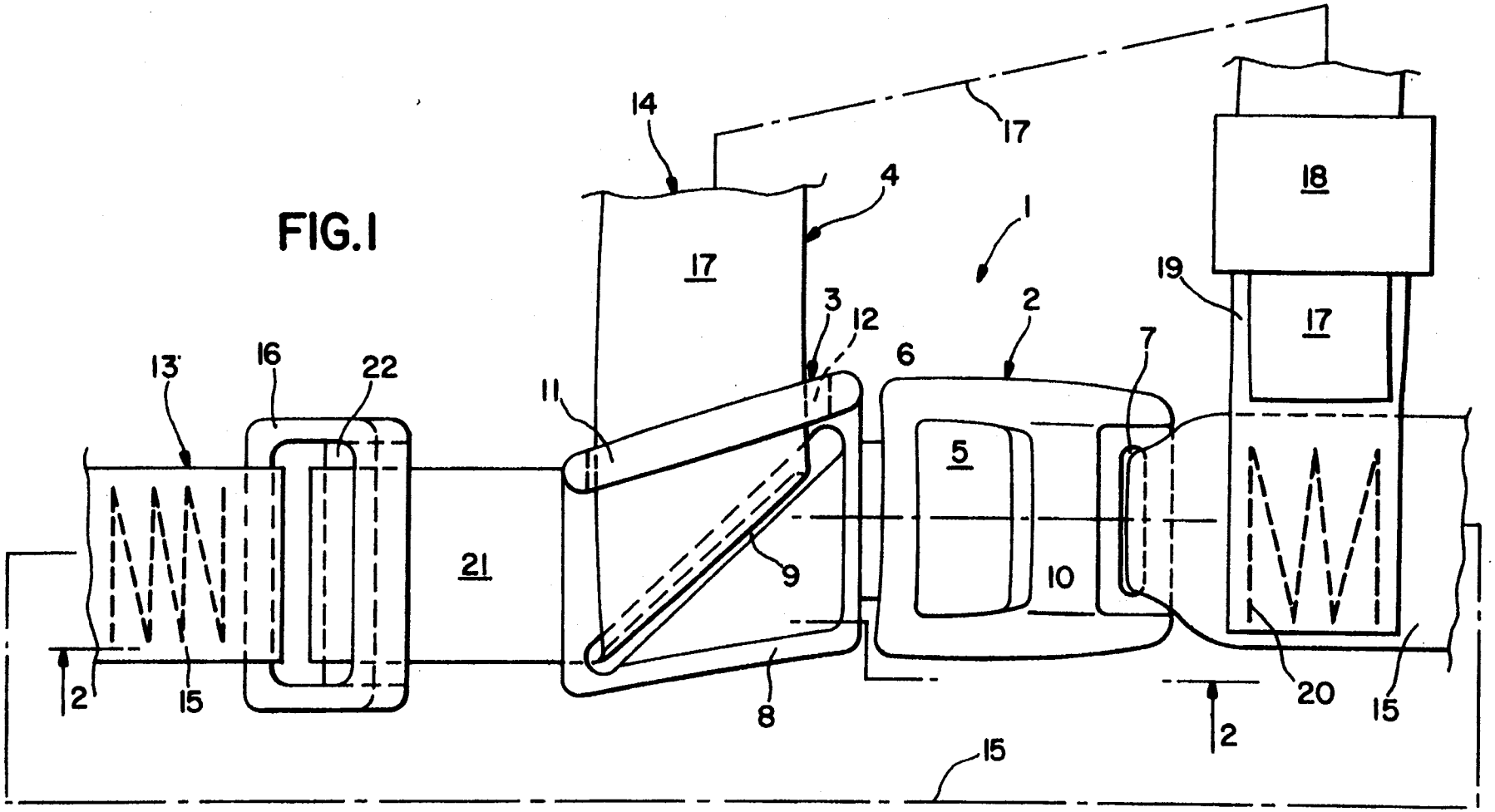

According to FIG. 1, the safety belt arrangement intended for a child safety seat in motor vehicles comprises the belt fastener 1, which is composed of a closure device 2 and a single end piece or insertion device 3 for a belt strap, as well as a belt strap arrangement generally designated 4. The closure device 2 has a conventional construction, so that not every detail is illustrated. It has a pressure-actuated button 5 in order to be able to release the end piece 3 from the closure device 2 in conventional manner. For this the end piece 3 has a conventional tongue 6 which is inserted in the closure device 2. The closure device is provided with a slot 7 for receiving a belt strap end on the side opposite the insertion side of the closure device 2.

The single end piece 3, which is inserted in the closure device 2 and serves to guide and retain a belt of the belt strap arrangement 4, comprises the fastener tongue 6 already mentioned as well as an essentially square or rectangular plastic component 8 supporting the fastener tongue and which has a belt guide slot 9, which in turn extends at an angle to the central longitudinal axis 10 of the closure device 2. As FIG. 1 shows, the guide slot 9 is placed so that it essentially intersects the axis 10 centrally when it extends diagonally in the component 8, in order to thus exert an at least approximately uniform pelvic belt tensile stress on the closure device 2. The end piece 3 itself is designed so that it has an at least approximately straight path together with the tongue 6, as can be seen from FIG. 1. Furthermore, the end piece 3 comprises on its upper side a clip 11, which together with the upper side of the end piece 3 forms a slot 12 which can be seen more clearly in FIG. 2. The clip 11 is provided in the upper edge region of the end piece 3 with reference to FIG. 1 and extends essentially parallel or somewhat inclined (FIG. 1) to the longitudinal axis 10 mentioned of the closure device 2. The passage slot 12 thus formed has a stabilising effect on the direction for the belt strap section passing through it with respect to the diagonal guide slot 9. Hence locking of the edge of the belt strap in the ends of the belt guide slot 9 is avoided.

The belt arrangement 4 basically comprises a pelvic belt 13 and a shoulder belt 14. The pelvic belt 13 preferably comprises an integral pelvic belt strap 15, one end of which is attached in the slot 7 of the closure device 2 and the other end of which supports an eye part 16, as FIG. 1 shows. The shoulder belt 14 preferably comprises a long belt strap 17, which can be adjusted longitudinally in the example shown by means of an adjuster 18, so that the length of the belt strap 17 may be adjusted in simple manner. The adjuster 18 is known per se and therefore only indicated schematically.

The adjuster 18 is attached to a relatively short belt strap piece 19 as a functional continuation of the shoulder belt strap 17, which piece 19 in turn is connected to the pelvic belt strap 15 by means of a seam 20 in order to attach the shoulder belt strap to one side of the pelvic belt. A loop formation for the shoulder belt strap piece 19 may also be provided instead of a seam linkage 20, so that the shoulder belt 14 has a certain lateral adjustment clearance depending on the application.

The shoulder belt strap 17 is also retained at the end piece 3 and at the eye part 16. The strap 17 is guided through the end piece 3, after it has passed movably in its longitudinal direction in a manner known per se through the child safety seat in the upper guides thereof, for example slots, and extends to the eye part 16 while forming a small pelvic belt section, through the eye part 16, and returns to the end piece 3, to which it is then attached, while forming a loop section 21. The loop 21 and the attachment of the end of the belt strap 17 can be seen more clearly from FIG. 2. The eye part 16 has a lower bar part 22 which is surrounded by the loop 21. The shoulder belt strap 17 is thus attached to the other side of the pelvic belt 13.

It is clear that tensile stress on the long part of the belt strap 17 passing through the end piece 3 leads to the loop 21 being made smaller according to the principle of a double purchase pulley, as a result of which the pelvic belt strap 15 is tightened with increased force when stressed and exerts a more secure retaining function. The traction thus exerted on the pelvic belt 13 is approximately twice as large as the traction of the shoulder belt strap 17. Furthermore, the belt fastener 1 cannot slide downwards when it is not stressed, because is it prevented from doing so by the firmly sewn other end of the short belt piece 19 of the shoulder belt 14. Hence no excess slack (play) can be produced in the shoulder belt as a whole.

Figure 2:
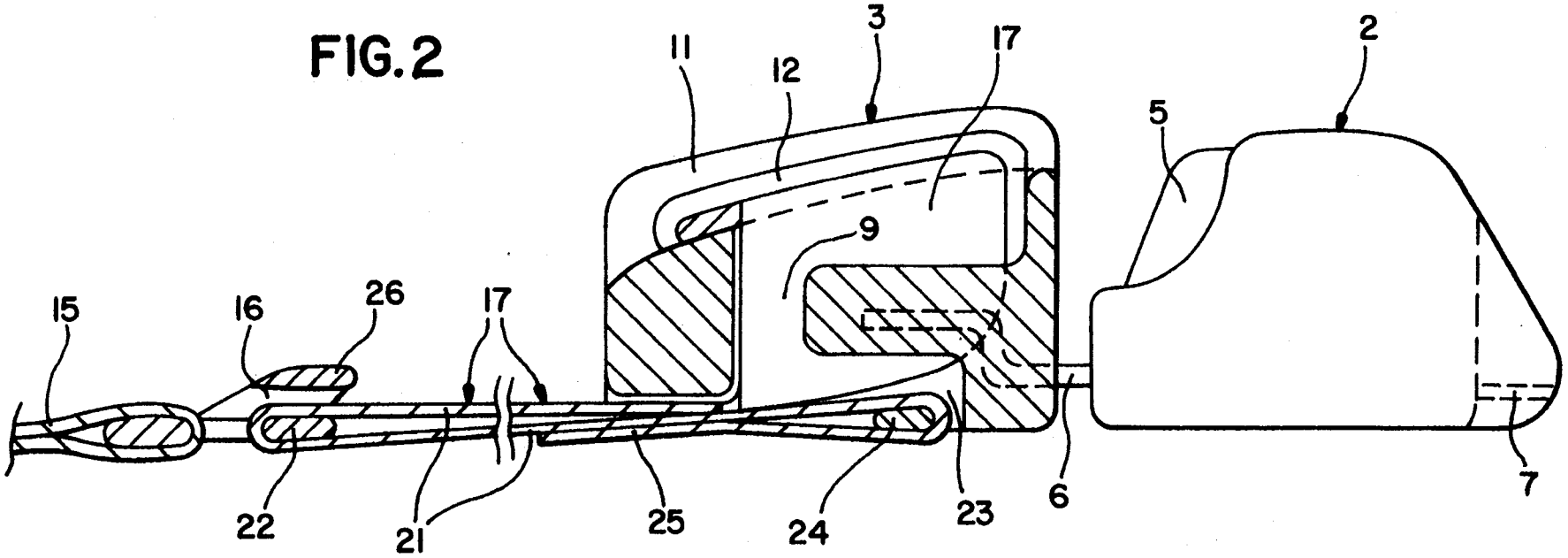

FIG. 2 shows that the end piece 3 for the shoulder belt strap 17 has on its lower side a depression 23, in which an attachment bar 24 is provided for mounting the end region of the belt strap 17. The shoulder belt strap end is thus placed around the bar 24 and then attached by means of seam linkage 25. Alternatively however, other possibilities for attachment of the end of the shoulder belt strap 17 to the end piece 3 may also be provided. Furthermore, the eye part 16 may be provided with a protective clip 26 to ensure secure passage of the belt section, forming the loop 21, of the belt strap 17, acting as pelvic belt in this region, of the shoulder belt 14. Finally, it should also be mentioned that the long belt strap 17 of the shoulder belt 14 may be equipped with an adjuster 18 on its other front section as well. The belt strap 17 may thus be divided once again into its upper region and may be attached here to the child seat by means of both upper ends. The pelvic belt may also have a divided design and may be attached to the child seat.

The present invention may be embodied in other specific forms without departing from the spirit or essential attributes thereof and, accordingly, reference should be made to the appended claims rather than to the foregoing specification as indicating the scope of the invention.

I claim:

1. A belt fastener with a safety belt arrangement including a shoulder belt and a pelvic belt for child safety seats in motor vehicles, comprising:

a closure device having a tongue engagement end, and a slot for coupling to a first end of the pelvic belt;

an insertion device having a fastener tongue connectable with the tongue engagement end of the closure device, and an inclined belt guide slot which intersects a central longitudinal axis of the closure device, a second end of the pelvic belt coupled to an eye part, a first end of the shoulder belt attached to the pelvic belt near the slot on the closure device, a second end of the shoulder belt extends through the inclined belt guide slot of the insertion device, through the eye part and is attached to the insertion device to form a longitudinally adjustable loop which is shortened when the shoulder belt is subjected to a tensile stress and consequently the pelvic belt is tightened with increased traction.

2. A belt fastener according to claim 1, characterised in that the insertion device has an attachment bar in a recess on a lower side, to which bar the second end of the shoulder belt forming the loop is attached.

3. A belt fastener according to claim 1, characterised in that the insertion device has a clip on an upper side in an upper edge region, which, together with an upper surface region of the insertion device, forms a direction-stabilising passage slot for the shoulder belt.

4. A belt fastener according to claim 1, characterised in that the inclined belt guide slot of the insertion device has an essentially quadrilateral shape arranged to extend diagonally therein.

5. A belt fastener according to claim 1, characterised in that the first end of the shoulder belt is sewn onto the pelvic belt.

6. A belt fastener according to claim 1, characterised in that the shoulder belt essentially comprises an integral belt strap, which is guided to be movable in an upper region of the child safety seat, and in that one of the two front shoulder belt sections thus formed is coupled to an adjuster adjusting the length of the shoulder belt.

* * * * *